US006481844B1

(12) United States Patent
Beery

(10) Patent No.: US 6,481,844 B1
(45) Date of Patent: Nov. 19, 2002

(54) APPARATUS, METHOD AND MEDIUM FOR PROVIDING AN OPTICAL EFFECT

(75) Inventor: Peter D. Beery, Cedar Park, TX (US)

(73) Assignee: Nortel Networks Limited (CA)

( * ) Notice: Subject to any disclaimer, the term of this patent is extended or adjusted under 35 U.S.C. 154(b) by 41 days.

(21) Appl. No.: 09/750,062

(22) Filed: Dec. 29, 2000

Related U.S. Application Data

(60) Provisional application No. 60/249,269, filed on Nov. 17, 2000.

(51) Int. Cl.[7] ..... B41J 2/01; B41J 2/06

(52) U.S. Cl. ..... 347/105; 347/104; 347/55

(58) Field of Search ..... 347/100, 104, 347/105, 55; 428/195; 106/31.58, 31.43; 359/463, 455

(56) References Cited

U.S. PATENT DOCUMENTS

| | | | | |
|---|---|---|---|---|
| 3,683,773 A | | 8/1972 | Dudley | |
| 4,631,548 A | | 12/1986 | Milbrandt | |
| 4,833,491 A | | 5/1989 | Rezandka | |
| 4,908,638 A | | 3/1990 | Albosta | |
| 5,182,571 A | | 1/1993 | Creagh | |
| 5,392,065 A | | 2/1995 | Suzuki | |
| 5,598,192 A | | 1/1997 | Burger et al. | |
| 5,710,582 A | | 1/1998 | Hawkins et al. | |
| 5,751,311 A | | 5/1998 | Drake | |
| 5,754,198 A | | 5/1998 | Nishikawa | |
| 5,886,722 A | * | 3/1999 | Kuehnle | 347/104 |
| 5,933,164 A | | 8/1999 | Sato et al. | |
| 5,933,276 A | | 8/1999 | Magee | |
| 5,992,991 A | | 11/1999 | Kanemoto et al. | |
| 6,024,438 A | | 2/2000 | Koike et al. | |
| 6,076,917 A | | 6/2000 | Wen | |

OTHER PUBLICATIONS

Magic Interlacer Pro 100, product advertisement, available at <<http://www.promagic.net/promagic/interlacer.html>>, accessed on Feb. 14, 2001, three pages.

Patent Abstracts of Japan, Abstract No. JP 281327 A2, entitled "Ink Jet Device and Ink Jet Method," issued on Oct. 27, 1995.

Paul Bourke, "Calculating Stereo Pairs," accessible at <<http://www.swin.edu.au/astronomy/pbourke/stereographics/stereorender/>>, Jul. 1999, eight pages.

The PC Technology Guide, accessible at <<http://www.pctechquide.com/13inkets.htm>>, update date Oct. 16, 1999, fifteen pages.

(List continued on next page.)

*Primary Examiner*—John Barlow
*Assistant Examiner*—Manish S Shah
(74) *Attorney, Agent, or Firm*—Hunton & Williams

(57) ABSTRACT

An apparatus for providing an optical effect includes a processor for controlling the operation of the apparatus, and an interface for receiving image information including multiple image elements. The apparatus further includes a printing head (such as an ink jet printing head) including a first dispensing mechanism for dispensing a colored ink, and a second dispensing mechanism for dispensing a clear ink. The processor includes printing logic for instructing the printing head to print at least one image element on a base medium using the first dispensing mechanism, and to print at least one lens-like lenticule on the medium, at a prescribed position relative to the image element, using the second dispensing mechanism. The lenticule modifies a viewer's perception of the image element to thereby achieve the optical effect. According to one embodiment, the clear ink forms a substantially spherical projection. Also disclosed is a method for creating a medium having at least one lenticule printed thereon, as well as the medium itself.

23 Claims, 9 Drawing Sheets

OTHER PUBLICATIONS

Michael Halle, "Autosteroscopic Displays and Computer Graphics," Computer Graphics, ACM, SIGGRAPH, 31(2), May 1997, pp. 58–62 (also accessible at <<http://www.media.mit.edu/people/halazar/autostereo/>>).

Paul Bourke, "Generating Autostereoscopic Lenticular Images," accessible at <<http://www.swin.edu.au/astronomy/pbourke/stereographics/lenticular/index.html>>, Dec. 1999, fourteen pages.

The Digital Darkroom: Lnticular Prints, accessible at <<http://www.shortcourses.com/book03/lenticular.htm>>, accessed on Dec. 9, 2000, eight pages.

Lake, "An Art Form That's Precise But Friendly Enough to Wink," reprint of New York Times Article, accessible at <<http://www.depthography.com/times.html>>, accessed on Dec. 9, 2000, eleven pages.

* cited by examiner

APPARATUS, METHOD AND MEDIUM FOR PROVIDING AN OPTICAL EFFECT

This application claims the benefit of U.S. Provisional Application No. 60/249,269, filed on Nov. 17, 2000, which is incorporated by reference herein in its entirety.

BACKGROUND OF THE INVENTION

The present invention generally relates to an apparatus, method and medium for providing an optical effect using a series of lenticules placed on a medium. In a more particular embodiment, the present invention relates to an apparatus, method and medium for providing an optical effect using a series of spherical-like lenticules printed on a medium using a printer.

Different technologies may be used to create two-dimensional media that provides "special" optical effects, such as the illusion of a three-dimensional presentation, or the illusion of an animated presentation. Parallax barrier displays, for instance, provide an opaque screen positioned over an image-bearing medium. The image-bearing medium includes a series of stripes of image information arranged in interleaved fashion. The screen includes a plurality of slits that serve as windows for viewing the stripes of information in the image presentation. In one configuration, a viewer may perceive different selections of stripes depending on his or her orientation with respect to the display. This effect allows the designer of the display to provide various types of animation effects. That is, a viewer may perceive that the display is "changing" its image presentation as he or she walks by the display. In another configuration, a viewer's left eye may perceive a different selection of stripes than the viewer's right eye. This effect allows the designer to provide various stereoscopic effects.

Another technology for providing optical effects uses lenticular display sheets. As shown in FIG. 1, a typical lenticular arrangement 100 includes an array of narrow cylindrical lenses 102 (also referred to as "lenticules") coupled to an image bearing-medium 104. Like the parallax barrier displays discussed above, the image-bearing medium 104 includes a series of stripes of image information arranged in interleaved fashion. In one configuration, the cylindrical lenticules on the lenticular sheet 102 focus the image information from the stripes in such a fashion that a viewer may perceive a first subset of strips (corresponding to a first scene) when positioned at a first orientation, and perceive a second subset of stripes (corresponding to a second scene) when positioned at a second orientation. This creates the illusion that the arrangement is "changing" its image presentation as the viewer walks by the arrangement. In another configuration, a viewer's left eye perceives a first subset of stripes (corresponding to a first scene), and a viewer's right eye perceives another subset of stripes (corresponding to a second scene). This creates the illusion of depth.

FIGS. 2(*a*) and 2(*b*) explain the physical mechanism which enables lenticular arrangements to function in the above-described manner. More specifically, FIG. 2(*a*) shows how a lenticular arrangement achieves the illusion of changing scenes. In this exemplary embodiment, the image-bearing medium 202 (shown in cross section) presents three different scenes, namely scenes "A," "B," and "C." These scenes are "sliced" into thin vertical stripes. The stripes are then interleaved so that a slice of scene "A" is positioned adjacent to a slice of image "B," and a slice of scene "B" is positioned adjacent to a slice of image "C." The thus formed image-bearing medium is coupled to the flat side of a lenticular sheet 204. In an alternative embodiment, it is known to print the image information directly on the flat side of the lenticular sheet 204.

In the case of FIG. 2(*a*), the lenticular sheet 204 focuses the light reflected from the image-bearing medium 202 so that a viewer perceives different scenes when positioned at different orientations with respective to the lenticular arrangement (or alternatively, the arrangement is tilted about axis "x" shown in FIG. 1, while the viewer remains stationary). Namely, the viewer may perceive the stripes corresponding to image "C" when stationed at position (1). The viewer may perceive the stripes corresponding to image "B" when stationed at position (2). And the viewer may perceive the stripes corresponding to image "A" when stationed at position (3).

Additional scenes may be included by interleaving additional stripes corresponding to respective additional scenes. The arrangement in FIG. 2(*a*) can accordingly create different effects depending on the content of the different scenes. The different scenes (e.g., "A," "B," and "C") may represent different "snap shots" in a motion sequence. Accordingly, the arrangement may create the illusion of motion as the user walks by the arrangement. Alternatively, the different scenes may have unrelated content.

FIG. 2(*b*) shows how a lenticular arrangement can achieve the illusion of a three dimensional presentation. Again, the image medium 262 (shown in cross section) presents three different scenes, namely scenes "A," "B," and "C." These scenes are "sliced" in thin vertical stripes. The stripes are then interleaved so that a slice of scene "A" is positioned adjacent to a slice of image "B," and a slice of scene "B" is positioned adjacent to a slice of image "C." The thus formed image medium is coupled to the flat side of a lenticular sheet 264

In the case of FIG. 2(*b*), the lenticular sheet 264 focuses the light reflected from the image-bearing medium 262 so that, at a particular orientation, a viewer's left eye perceives scene "C," while the viewer's right eye perceives scene "B." The thus commingled image creates the perceived effect of a three dimensional presentation (when "processed" by the viewer's brain).

The optical effects produced by the lenticular arrangement 100 shown in FIGS. 1 and 2 are observable when the viewer changes his or her orientation with respect to the normal of any lenticule. For instance, with reference to FIG. 1, a viewer will observe the optical effects when the viewer changes his or her position in the "horizontal" direction. This is equivalent to tilting the arrangement 100 about the axis "x." However, a viewer will typically not observe the special optical effects when he or she changes position in the "vertical" direction of the arrangement (where the "vertical" direction corresponds to movement along the axes of the lenticules, such as axis "x").

FIG. 3 shows another type of lenticular arrangement, referred to in the art as an "integram" or "integral photograph." This arrangement replaces the sheet of cylindrical lenticules with a sheet 302 containing a regular array of spherical lenses on its surface 304. This sheet 302 is coupled to an image-bearing medium 306. This type of lens configuration has the potential of allowing a user to view optical effects when the viewer changes his position in both the "horizontal" and "vertical" directions relative to the surface of the arrangement. Exemplary patents disclosing the use of spherical lenses to create an optical effect include U.S. Pat. Nos. 3,683,773 and 5,933,276. Also note FIG. 6 and the accompanying discussion of Michael Halle, "Autostereoscopic Displays and Computer Graphics," Computer Graphics, ACM SIGGRAPH, 31(2), May 1997, pp. 58–62.

There are shortcomings with respect to known lenticular-type arrangements. For instance, misalignment of the lenticular sheet with the underlying image-bearing medium may create visual artifacts in the perceived image. More specifically, alignment artifacts may result when the image-bearing medium is angularly skewed relative to the lenticular array. Alignment artifacts may also result when the spacing of the lenticules does not precisely match the spacing of the image stripes. Alignment artifacts may also result when the spacing between the lenticules or between the interlace stripes vary slightly from region to region. Generally speaking, alignment artifacts limit the resolution (granularity) in the resultant perceived image. Further, the additional care that must be taken to ensure proper alignment may increase the cost of production of these lenticular arrangements.

Some practitioners have attempted to remedy the alignment difficulties by, as noted above, printing the image directly on the flat side of a lenticular sheet. Others have proposed mechanisms for electronically detecting the alignment between the printed medium and the lenticular sheet using various types of sensor arrangements. However, these solutions may require complex and potentially expensive adaptations to existing printing mechanisms.

With respect to the use of integrams, the above-referenced Halle article states that integrams are less common than their cylindrical lenses counterparts mostly because their spatial resolution is scarified to directional information. Further, insofar as an integram sheet is coupled with an image-bearing medium in the manner described above, this technology suffers from all of the alignment difficulties described above. Indeed, these alignment problems may be exacerbated because of the need to align the sheet in both the horizontal and vertical directions relative to the image-bearing medium. These difficulties may have prevented those skilled in the art from appreciating the full potential of spherical lenses.

Additional unspecified deficiencies may exist in known lenticular displays.

There is accordingly a need for a more effective apparatus, method and medium for providing optical effects from a two-dimensional image-bearing medium.

SUMMARY OF THE INVENTION

The present invention addresses the above-identified needs, as well as additional unspecified needs.

One exemplary aspect of the invention pertains to an apparatus for producing an image-bearing medium that provides an optical effect. The apparatus includes a processor for controlling the operation of the apparatus, and an interface for receiving image information including multiple image elements. The apparatus further includes a printing head (such as an ink jet printing head) including a first dispensing mechanism for dispensing a colored ink, and a second dispensing mechanism for dispensing a clear ink. The processor includes printing logic for instructing the printing head to print at least one image element on a base medium using the first dispensing mechanism, and for printing at least one lens-like lenticule on the medium, at a prescribed position relative to the at least one image element, using the second dispensing mechanism. The at least one lenticule modifies a viewer's perception of the at least one image element, to thereby achieve the optical effect. According to one embodiment, the clear ink forms a substantially spherical lenticule.

Another aspect of the invention pertains to a method for providing an optical effect. The method includes an initial step of accessing an image source containing image information including multiple image elements. The method then includes the steps of printing at least one image element on a base medium using a colored ink, and printing at least one lenticule on the base medium, at a prescribed position relative to the at least one image element, using a clear ink.

Another aspect of the invention pertains to an image-bearing medium for providing an optical effect. The image-bearing medium includes a base medium. The image-bearing medium further includes at least one image element printed directly on the base medium using a colored ink, and at least one lenticule printed directly on the base medium using a clear ink, at a prescribed position relative to the at least one image element.

The use of a printer to print lenticules directly on a base material (such as paper or a plastic transparency) reduces the alignment problems found in known lenticular arrangements. Further, the technique allows the formation of spherical lenticules with improved accuracy and ease compared to known systems, thus potentially eliminating some of the concerns that have been identified with respect to integral technology. This enables the development of new optical effects using the spherical lenses that have heretofore not been envisioned.

BRIEF DESCRIPTION OF THE DRAWINGS

Other features of the present invention will be apparent from consideration of the following Detailed Description, in conjunction with the accompanying drawings, in which:

FIG. 2(*b*) illustrates the use of the arrangement of FIG. 1 to provide a stereoscopic effect;

DETAILED DESCRIPTION OF THE INVENTION

1. Apparatus

Figure 4:
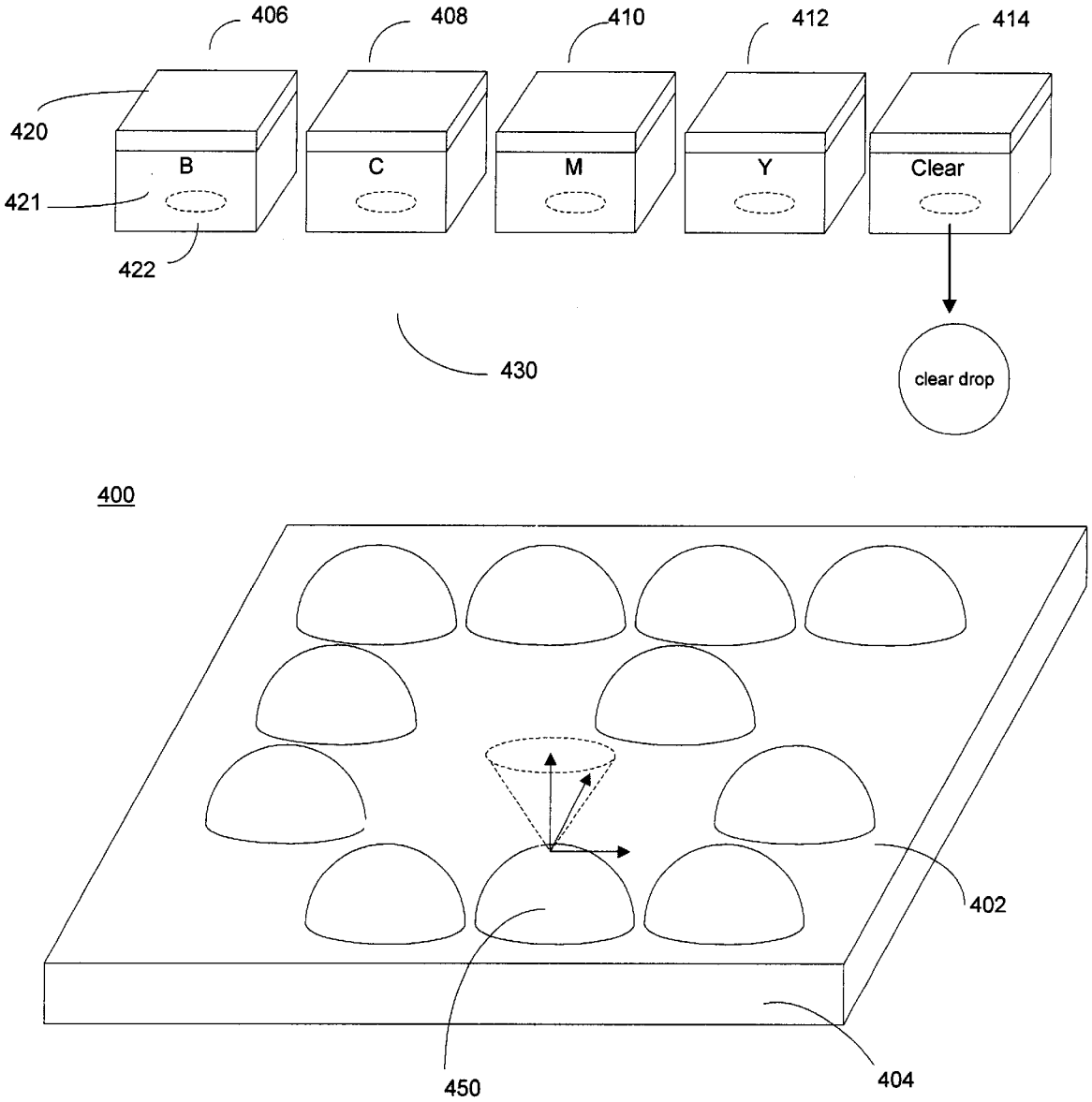
FIG. 4 shows an exemplary lenticular arrangement according to the present invention, along with a high-level depiction of a recording head for producing the arrangement.

FIG. 4 shows a high-level overview of part of an apparatus used to print image information (composed of image elements) and lenticules on the surface 402 of a base medium 404 (such as a paper or plastic sheet). More specifically, the apparatus includes a printing head 430. The printing head receives commands from a processor (not shown) for printing the image elements and lenticules on the surface 402 of the base medium 404. As used herein, an "image element" may refer to an individual dot printed by printing head 430, a pixel of image information, or a larger element (e.g., in the case of an image element produced by dither processing).

The printing head 430 may include multiple dispensing mechanisms. More specifically, in a monochrome embodiment, the apparatus employs dispensing mechanism 406 for printing image elements on the surface 402 of base medium 404 using black-colored ink. In a color embodiment, the apparatus employs multiple dispensing elements to form respective multiple colored image elements. That is, the apparatus employs: dispensing mechanism 406 for printing image elements using black-colored ink; dispensing mechanism 408 for printing image elements using cyan-colored ink; dispensing mechanism 410 for printing image elements using magenta-colored ink; and dispensing mechanism 412 for printing image elements using yellow-colored ink. Moreover, the printing head 430 also includes dispensing mechanism 414 for printing lenticules on the surface 402 of base medium 404 using clear-colored ink. A "lenticule" generally refers to a small element having lens-like properties.

The printing head 430 may be implemented using any one of a variety of technologies. For example, the printing head 430 may comprise a mechanism for dispensing ink using ink jet technology. Ink jet technology pertains to a class of non-impact printing devices that emit ink from nozzles as their printing heads pass over the medium (typically paper). More specifically, an ink jet printer head prints out image information at the command of a processor by scanning the medium in horizontal passes. To do so, it uses a motor assembly to move the head horizontally across the page, and another motor assembly to move the paper in vertical steps.

The actual mechanism for dispensing ink may vary depending on the technology used. Most ink jets printers use thermal technology to dispense ink. In this technique, a heating element (e.g., heating resistor) is used to heat a quantity of ink in a firing chamber. This causes an ink bubble to form. The pressure caused by the heat eventually causes the bubble to burst. A drop of ink is then emitted from a nozzle formed in the chamber. The drop of ink linearly travels a short distance to the surface of the medium, where it makes a small dot on the medium. A typical nozzle has a diameter of approximately 70 microns, and delivers drop volumes of approximately 8–10 picolitres. A typical dot size is between 50 and 60 microns in diameters.

Another type of ink jet printer uses piezo-electric technology. In this technique, a piezo-electric crystal element located at the back of the chamber receives an electrical signal when it is commanded to emit a drop of ink. This causes the piezo-electric element to flex, and in doing so, expel a drop of ink from its firing chamber via the nozzle.

Some ink jet printers use inks that exist in liquid form at room temperature. Other ink jet printers use inks that exist in solid form at room temperatures. The later class of printers therefore employ a heating mechanism to convert the solid ink to a liquid form prior to printing. These types of printers are commonly referred to as "hot melt" ink jet printers, "wax jet" printers, or "phase change" printers. These types of printers commonly use inks containing dyed wax, which produces bright colors.

The printing head shown in FIG. 4 generally represents any of the above type of printing technologies, as well as other unspecified printing technologies. With reference to exemplary dispensing mechanism 406, this mechanism includes a firing mechanism 420 coupled to a firing chamber 421. For instance, the firing mechanism 420 may represent a heating element (with respect to a thermal ink jet printer) or a piezo-electric element firing mechanism (with respect to a piezo-electric ink jet printers). When activated, the firing mechanism 420 causes a drop of ink to be expelled from the firing chamber 421 through a nozzle 422 toward the base medium 404. When an image-forming drop strikes the base medium 404, it forms a small dot (which is typically too small to see with the naked eye). When a clear ink drop strikes the base medium, it forms a convex lenticule, such as lenticule 450.

All of the dispensing mechanisms shown in FIG. 4 may use inks that exist in liquid form at room temperature ("liquid phase inks"). Alternatively, all of the dispensing mechanisms may use inks that exist in a solid form at room temperature ("solid phase inks"). Still alternatively, some of the dispensing mechanisms may use liquid phase inks, while other mechanisms may use solid phase inks. For instance, it may be desirable to use dispensing mechanisms that use liquid phase inks to dispense colored inks, but to use a dispensing mechanism that uses a solid phase ink to dispense the clear ink used to form the lenticules. This is because hot melt inks typically include wax-like substances which may produce convex shapes (which is a property conducive to the formation of lenticules). However, lenticules may also be formed with inks that exist in liquid form at room temperature.

The apparatus may also be produced by retrofitting a commercially available printing apparatus with an additional dispensing mechanism for dispensing the clear ink, or by using a pre-existing dispensing mechanism to dispense the clear ink (instead of a colored ink). Such retrofitting, however, may require appropriate modification to the processor functionality to ensure it takes account for the inclusion of the clear ink dispensing mechanism.

Exemplary background information regarding multi-color printing heads may be found in the U.S. patent literature, such as in U.S. Pat. No. 5,598,192, U.S. Pat. No. 4,833,491, U.S. Pat. No. 6,076,917, U.S. Pat. No. 4,631,548, U.S. Pat. No. 4,908,638, U.S. Pat. No. 5,710,682, U.S. Pat. No. 5,751,311, U.S. Pat. No. 5,754,198, U.S. Pat. No. 6,024,438, and U.S. Pat. No. 5,933,164. The last-mentioned U.S. Patent specifically includes a printing head for printing multiple colored inks, as well as a clear-colored ink.

Figure 5:
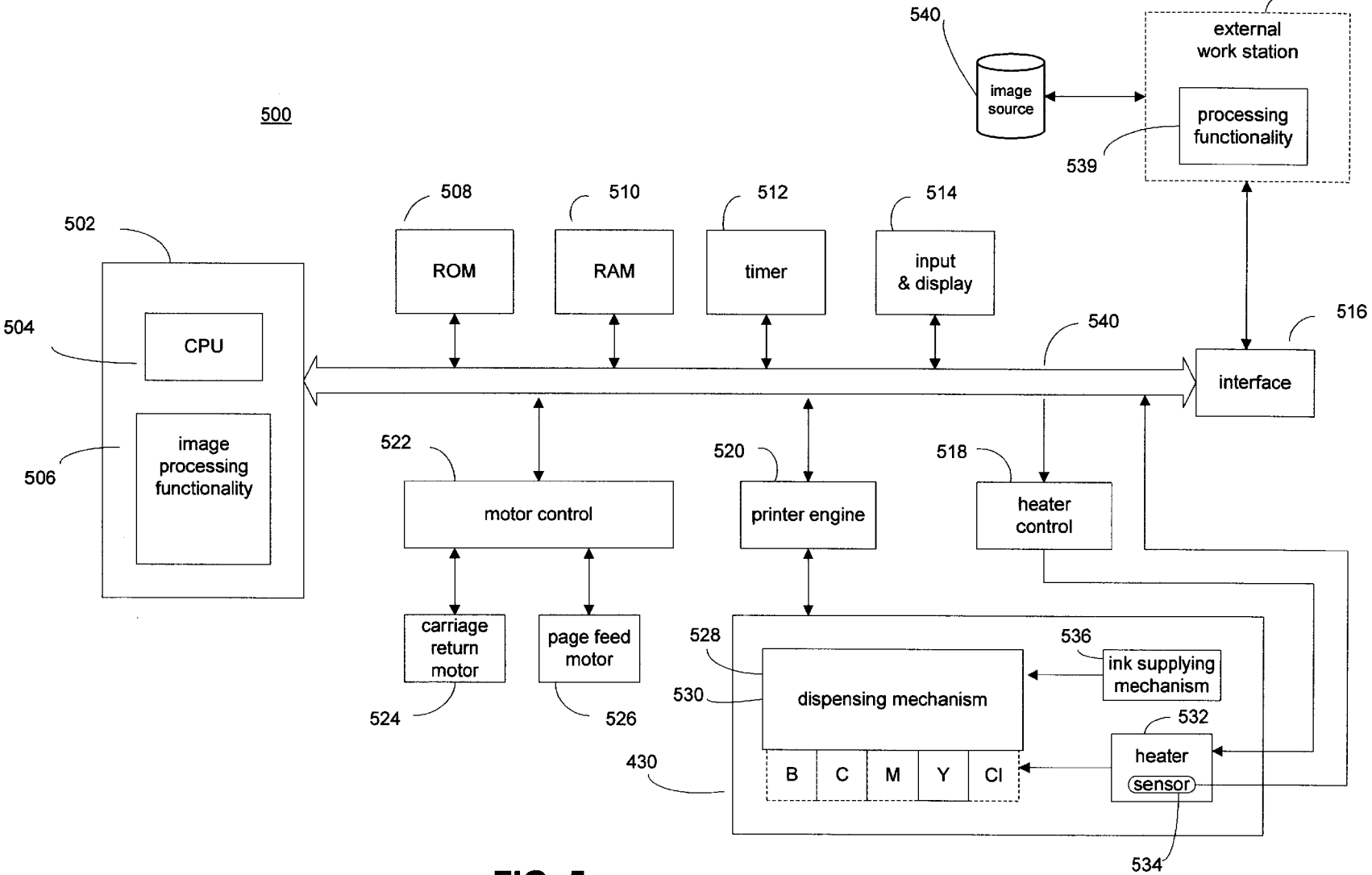
FIG. 5 shows an apparatus for producing the lenticular arrangement shown in FIG. 4.

FIG. 5 provides further details regarding the general architecture of an apparatus 500 employing the printing head 430 shown in FIG. 4. The exemplary apparatus 500 includes an interface 516 for receiving image information via an external work station 538.

More specifically, the work station 538 may comprise any general or special purpose computer for generating or supplying image information to apparatus 500. In one exemplary embodiment, the computer work station 538 includes software functionality 539 for receiving image information from image storage 540, and for processing the image information in an appropriate manner to achieve a special optical effect. For instance, the image information may originally comprise two or more image scenes. In this case, the functionality 539 divides the image scenes into plural stripes and then interleaves the stripes in known fashion to provide either the illusion of animation, the illusion of depth, or some other optical effect. Such processing culminates in the generation of composite image information which enables the printing apparatus 500 to print the image elements in an appropriate manner. Such information may call for the use of only a black-ink dispensing mechanism to produce a monochrome image on the base medium, or it may call for the use of multiple colored ink dispensing mechanisms to produce a colored image on the base medium.

The work station 538 may further define the location where the lenticules should be printed relative the image elements to achieve the desired optical effect. For instance, selected lenticules may be formed directly over optical elements. Other lenticules may be printed so that they are offset from the optical elements.

An exemplary commercial software product for performing lenticular calculations is the Magic Interlacer Pro 100 produced by ProMagic.

The image information received via interface 516 may be transferred via bus 540 to processor 502 of apparatus 500. The processor 502 may include a microprocessor 504 and various processing functionality 506 for processing the image information. Such functionality 506 may be implemented by program code, which is executable by the microprocessor 504. Such processing functionality 506 may serve to translate the data generated by the external work station 538 to a series of instructions that may be directly applied to control the operations of the printing head 430 via the printer engine 520. The printer engine 520 may provide further translation of the instructions, and may also control other aspects of the printing operation, as known in the art. A Read Only Memory (ROM) 508, Random Access Memory (RAM) 510, and timer 512 serve conventional storage and time-keeping functions in the operation of the printing apparatus 500.

The printing head 430 itself may include the five printing dispensing mechanisms shown in FIG. 4(denoted collectively here as mechanisms 530). These mechanisms 530 may include thermal-type ink jet dispensing mechanisms, piezoelectric-type dispensing mechanisms, or some other type of dispensing mechanisms.

An ink supplying mechanism 536 supplies ink to the dispensing mechanism 530. The ink dispensing mechanism may comprise a series of conduits (not shown), which supply ink to the dispensing mechanisms 530 from respective main ink reservoirs (not shown). In the event that phase-change inkjet technology is used, the head mechanism may include a heater 532 controlled by a heater control mechanism 518. In this case, the printing head 430 may use a sensor (e.g., a thermostat or thermocouple) to provide feedback to the processor 502 via the bus 540 regarding the temperature of the heated ink supply.

A motor control 522 serves to coordinate the movements of the printing head 430 and page feed operation using a carriage return motor 524 and a page feed motor 526, respectively. Finally, an input/display module 514 provides a keyboard (or like input means) for inputting commands and for setting control options to govern the operation of the apparatus 500, and an output display mechanism for displaying instructions, status messages, error messages, etc. in conventional fashion.

Further exemplary background details on printer processing equipment and functionality may be found in U.S. Pat. Nos. 5,392,065 and 5,992,991.

2. Method

Figure 6:
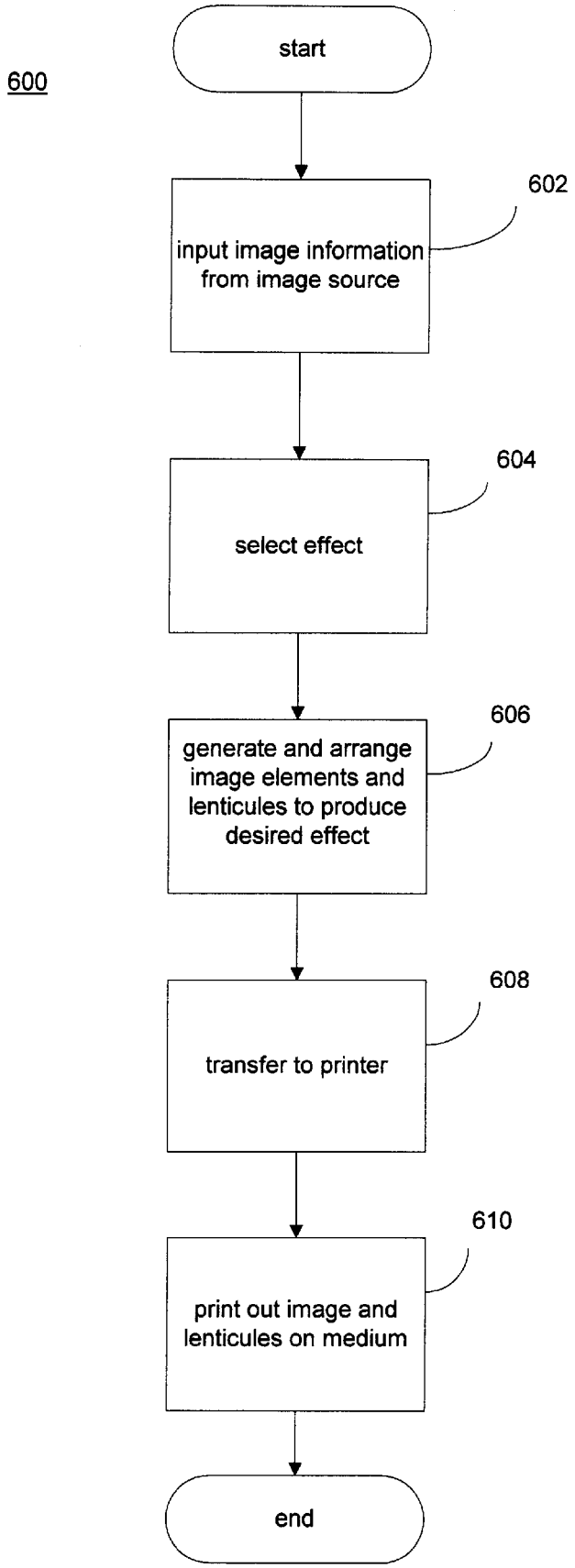
FIG. 6 shows a method of producing the lenticular arrangement shown in FIG. 4.

FIG. 6 shows an overview of the method used to operate the apparatus shown in FIG. 5. In step 602, the method includes the step of inputting the image from an image source. This step may entail, for instance, inputting image information from the database 540 to the external computer 538 (with reference to FIG. 5). The image information may comprise multiple image scenes, as previously discussed. Thereafter, in step 604, an operator selects the optical effect that he or she desires. Possible effects include animation effects or stereoscopic effects. Further, animation effects generally allow a user to achieve a wide variety of related effects. For instance, a designer can provide the illusion of motion by interleaving multiple "snap shots" of an object's motion taken in close temporal succession. A designer can give the illusion of"morphing" by interleaving multiple scenes in which an object transforms from one state to another. A designer can also give the illusion of "zooming in" or "zooming out" by interleaving multiple scenes corresponding to successive stages of positional proximity to an object. Still other effects may be obtained. Moreover, as will be discussed in section No. 3 below, the invention allows a designer to combine different effects in a single lenticular arrangement. That is, different effects may be observed depending how the viewer tilts the arrangement (or changes his or her position with respect to the arrangement).

In step 606, the work station 538 (or other device) is used to generate and arrange the image elements and lenticules to produce the desired effect selected in step 604. The algorithms used here are known in the art, as exemplified by the above-cited reference material. This step culminates in the generation of composite interlaced image data, as well as lenticule placement-position information. This enables the printing apparatus to produce the optical arrangement.

In step 608, the work station 538 transfers the composite image information to the image apparatus 500. In step 610, the printing apparatus prints out the image elements and the lenticules in accordance with the instructions received from the work station 538 and its internal processor 502 and printer engine 520. Depending on how the printing apparatus 500 is configured, the optical elements and their associated lenticules can be printed in a single pass. In alternative embodiments, the printing apparatus 500 may print lenticules on top of image elements that have been printed in previous rows. This can be achieved by offsetting the dispensing mechanism that prints clear ink from the other dispensing mechanisms.

3. Medium

Having discussed an exemplary apparatus and method for producing the medium, it is now possible to examine the properties of the medium itself in greater detail. Returning momentarily to FIG. 4, the lenticules are printed directly on the surface 402 of the medium 404. The medium 404 may comprise any base material, such as a paper-based product (e.g., any paper or cardboard), a plastic material (such as a transparency), metal material, or some other material. Further, the base material 404 may comprise material shaped in sheet-like form, or may comprise any type of card, ornament, container, or other article capable of receiving the image elements and the lenticules.

Figure 3:
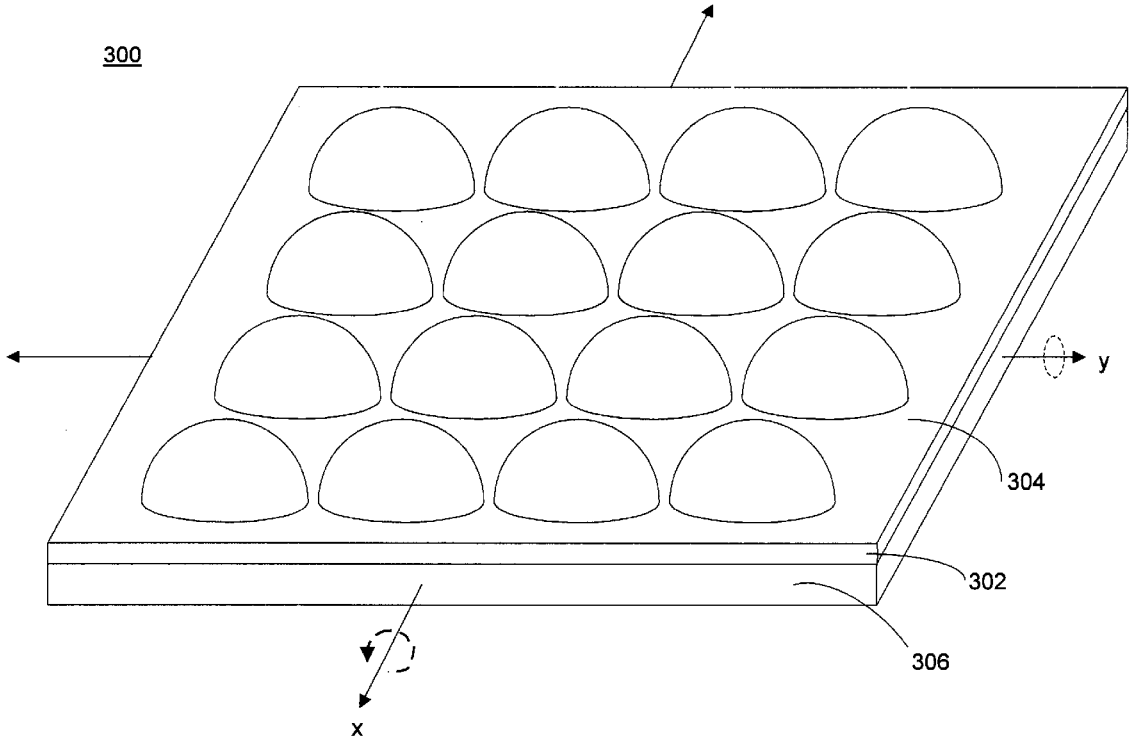
FIG. 3 shows a lenticular arrangement using spherical lenticules.

The lenticules may be arranged in any fashion to achieve the desired optical effect. In one embodiment, the lenticules are arranged in a regular array (e.g., as in the case of FIG. 3). In another embodiment, the lenticules are arranged in an irregular pattern. This later embodiment allows a designer to position the lenticules only where they are needed. For instance, a typical document contains a large body of white space. It is not necessary to provide any lenticules in this space, as there are no image elements in this space. This feature achieves a notable savings in ink and improvement in printing efficiency.

The lenticules can be formed using any type of substantially transparent ink.

Here, "substantially transparent" may include inks having various tints, and thus need not be absolutely clear to achieve the desired optical effects. It is generally preferred to select an ink that is clear enough to transmit light without too large a degree of non-refractive scattering. The ink should preferably also have sufficient hardness when it dries, so that the lenticules will not easily deform or scratch after being deposited. The ink should also preferably have a relatively high viscosity, which enables it to bulge into a convex lens shape when it contacts the medium. The ink should preferably have a fast cure time so that it hardens quickly when deposited. The ink should also preferably have favorable storage properties, so that it does not harden before being deposited. Generally, plastic-type inks and wax-based inks are satisfactory. One ink that meets these criteria is a UV (ultraviolet) curing ink (Abrasion Gloss 7025) produced by the Deco-Rad Corporation of Mishawaka, Ind. Further, as noted above, the ink jet printer may also allow phase-change inks to be used, which provides yet further choices in the inks that may be used.

The lenticule may be spherical (e.g., having a circular cross section). In alternative embodiments, the lenticule may have other shapes, such as an elliptical shape. Still alternatively, one or more surface portions of the lenticule can be flat to achieve different optical effects, or may have other shapes to achieve special optical effects. In one exemplary embodiment, a typical lenticule is approximately 50 microns in diameter, although larger or smaller lenticules can be used. The size of the lenticule can be controlled via appropriate instructions sent to the clear-ink dispensing mechanism 414 shown in FIG. 4.

Generally, visible light has a wavelength of approximately 0.5 microns. This is about 1/50 of the size of a typical inkjet printer dot. Thus, standard optical principals govern the interaction of visible light with the images and lenticules formed on the base medium.

More specifically, FIG. 4 shows that the exemplary lenticule 450 may create optical effects in a plurality of directions, such as both the horizontal and vertical directions. It is also possible to create optical effects when the optical arrangement is rotated about its two diagonal axes.

The optical effects produced by an exemplary lenticule is illustrated in greater detail with reference to FIGS. 7(*a*) and 7(*b*). More specifically, FIG. 7(*a*) shows an exemplary arrangement of nine image elements (i.e., numbered 1–9) formed on the base medium 404 in FIG. 4. Each element may correspond to individual dots formed by the ink jet printer, individual pixels formed by the ink jet printer (which may comprise several dots), or aggregate pixels areas (such as composite areas formed by dithering). As shown by the dark arrow in FIG. 7(*a*), a clear ink drop 504 may be printed directly over the nine image elements. Thus, the apex of the drop 504 is centered directly over image element No. 5.

Figure 2A:
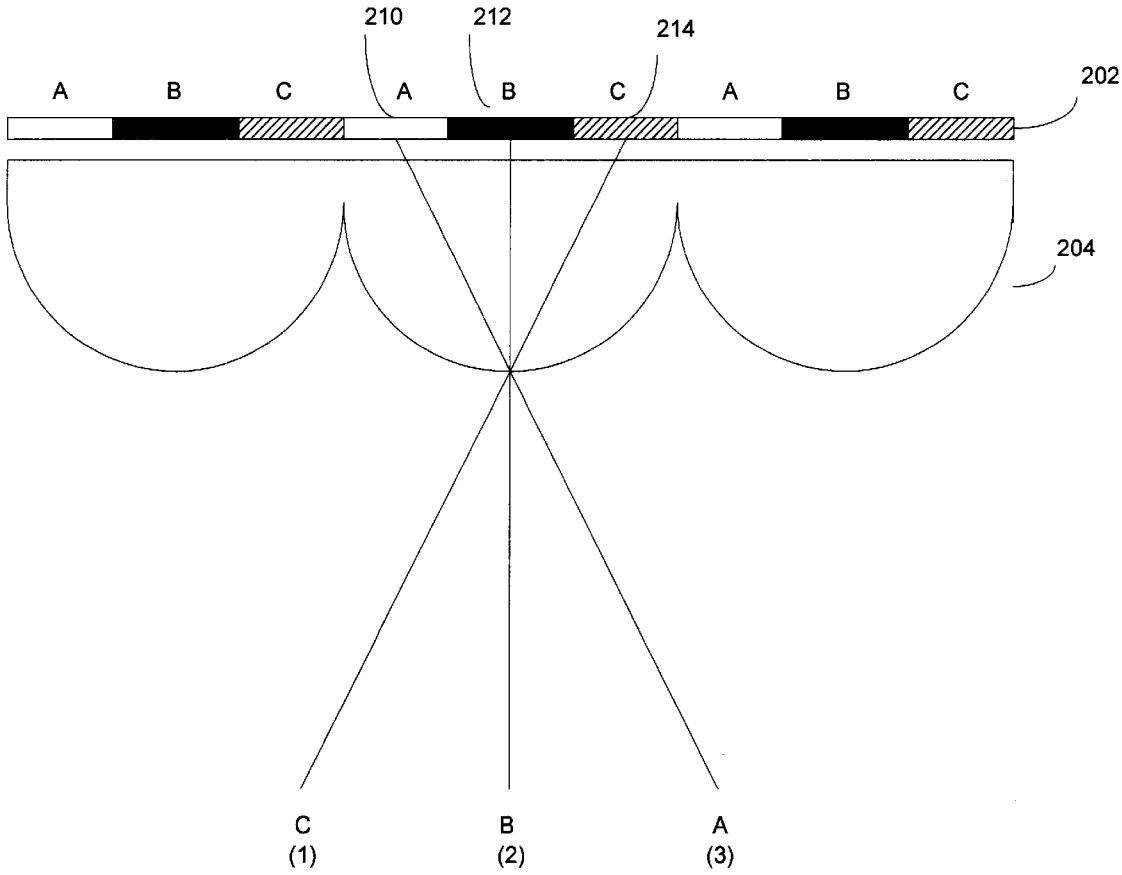
FIG. 2(*a*) illustrates the use of the arrangement of FIG. 1 to provide a "changing scene" effect.
Figure 2B:
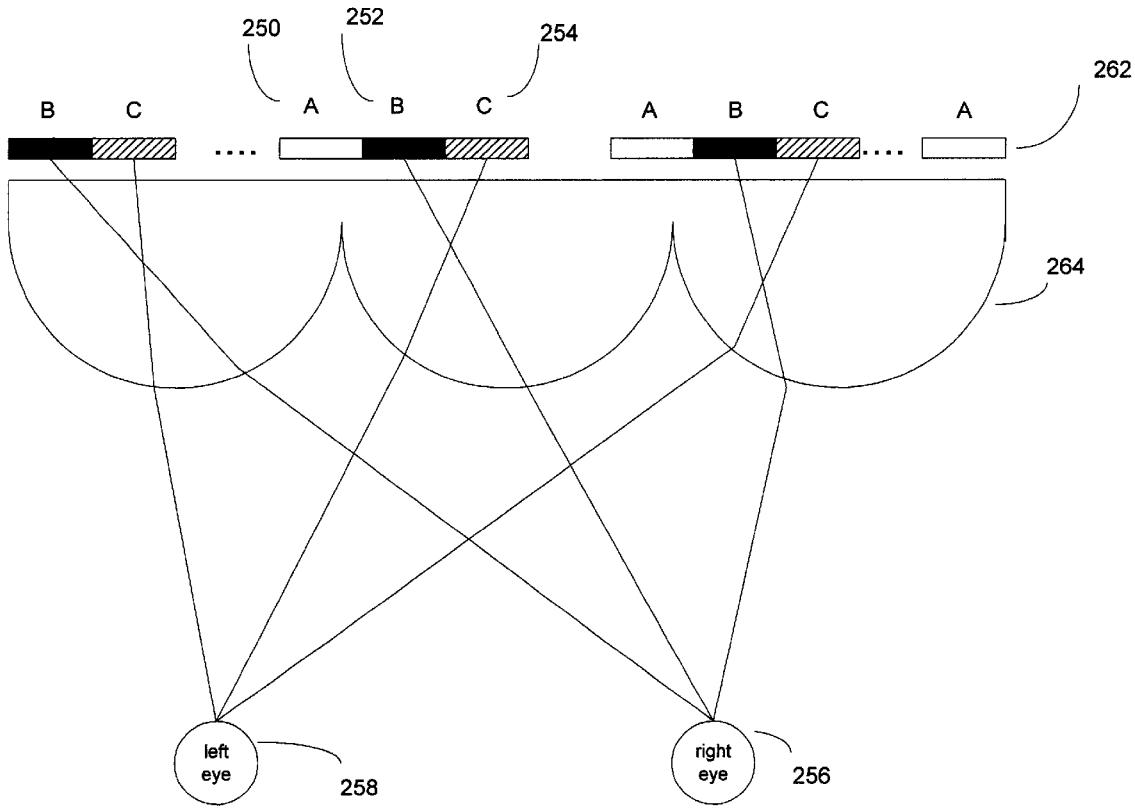
Figure 7A:
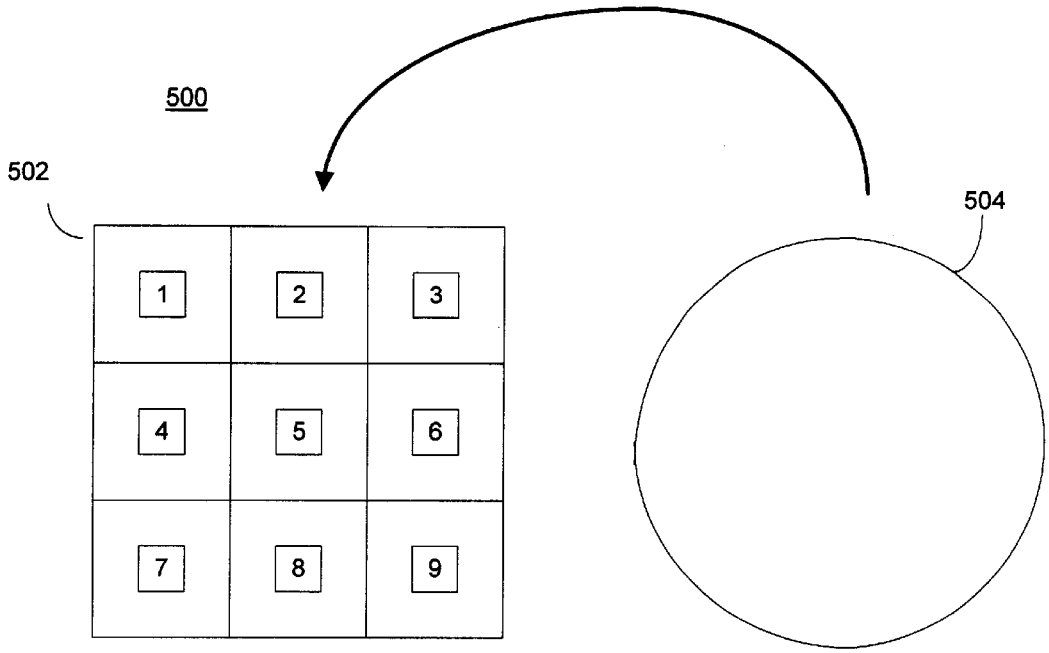
FIGS. 7(*a*) and 7(*b*) illustrate the optical properties of an exemplary lenticule shown in FIG. 4.
Figure 7B:
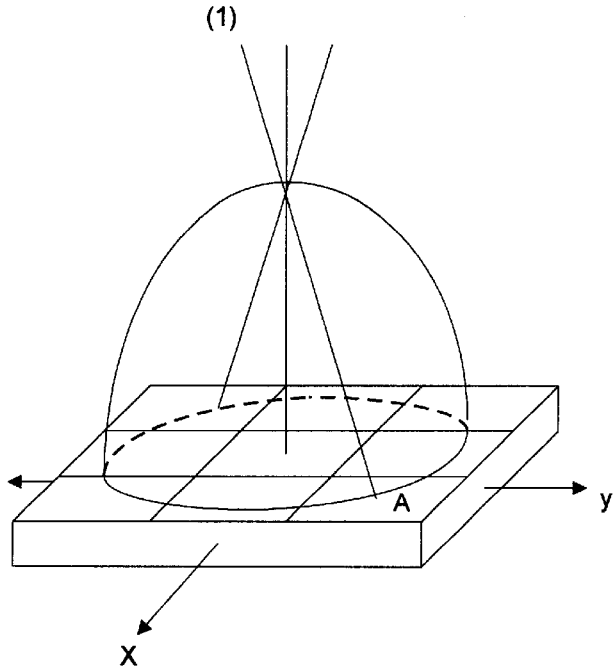

FIG. 7(*b*) shows the optical effect produced by placing the clear ink drop over the nine image elements. The effect is similar to the phenomena shown in FIG. 2(*a*), but is duplicated with respect to a plurality of additional effect-producing directions providing by the spherical-like shape of the ink drop. This means that, for example, a user positioned along the trajectory (1) will see image scene "A," which corresponds to image element 1 (shown in FIG. 7(*a*)). A similar effect applies to the other image elements shown in FIG. 7(*a*).

The effect produced by the above arrangement may vary depending on the information that is printed on the base medium 402, as well as the placement of lenticules relative to that information. As described above, animation and stereoscopic displays, or a combination thereof, can be implemented. The dots of clear ink may be purposely deposited on top of target image elements or off-center with respect to target image elements. Depositing the lenticules off center with respect to the target pixels may be a useful technique in steering appropriate images to the left and right eyes of the user to achieve a stereoscopic effect.

Figure 1:
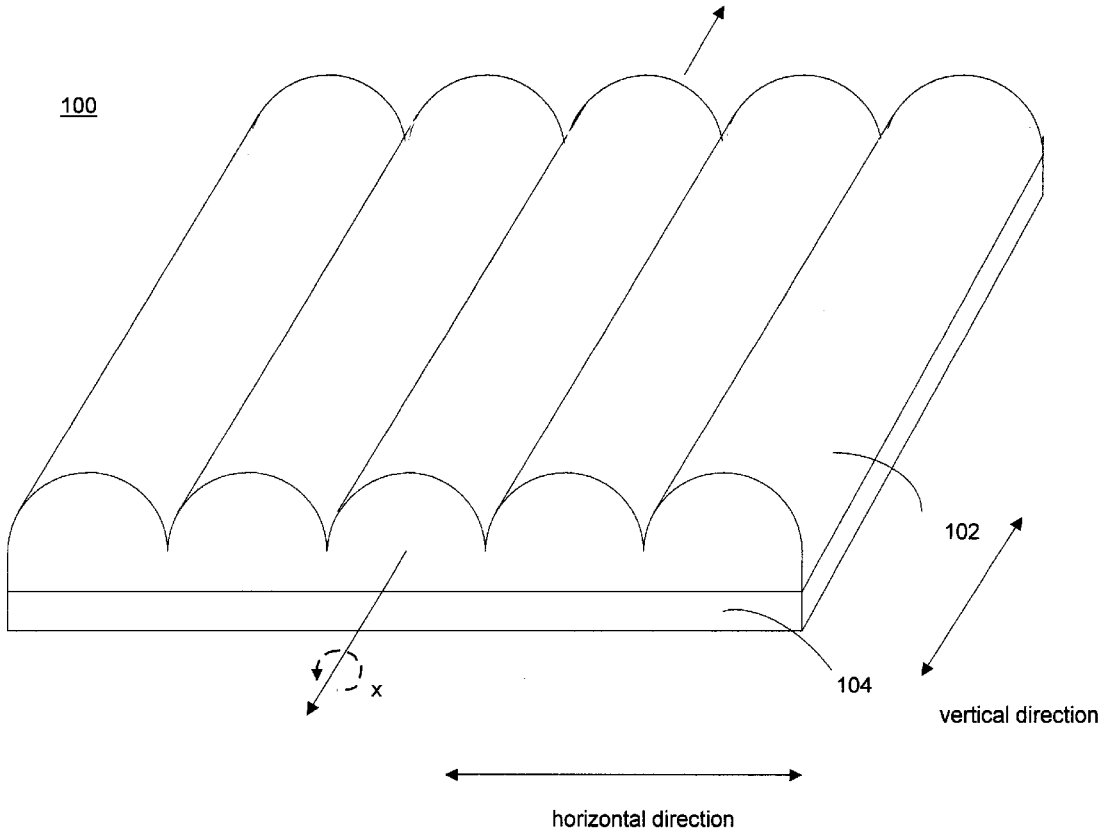
FIG. 1 shows a lenticular arrangement using cylindrical lenticules.

The placement of image elements and lenticules can be calculated by first identifying different effects provided by the spherical lenses. For instance, in the example shown in FIG. 7(*b*), the optical arrangement produces a separate effect as it is rotated about axis "x." Image element Nos. 4, 5 and 6 principally contribute to this effect. Hence, in computing the placement of images elements to achieve this effect, a designer may restrict his or her analysis to the placement of element Nos. 4, 5 and 6. Cylindrical lenticular formulas (discussed with reference to FIG. 1) apply to this calculation. In this manner, a designer may compute the placement of image elements and lenticules, e.g., by separating the effects provided by the lenticules, and by separately addressing each effect.

4. Exemplary Alternative Uses

As described above, the image medium may comprise any sheet-like type of material. Alternatively, it may comprise a transparency. In this case, a transparency may be formed including a regular (or irregular) array of lenticules. This transparency can then be positioned over a display provided by any electronic device, such as any type of flat display device, e.g., Liquid Crystal Display (LCD) or plasma-type device. The transparency would thus has the same effect on the pixels that are displayed on the screen as the pixels formed on the hard-copy paper medium discussed above. Misalignment between the lenticules and the displayed pixels can be adjusted by changing the spacing between displayed pixels using the control mechanism (not shown) of the display device, or may be achieved by a trial and error approach (e.g., by printing a transparency, noting the misalignment produced when it is superimposed over the display, making appropriate adjustments to the lenticule spacing in the transparency, and then repeating the process).

Figure 8:
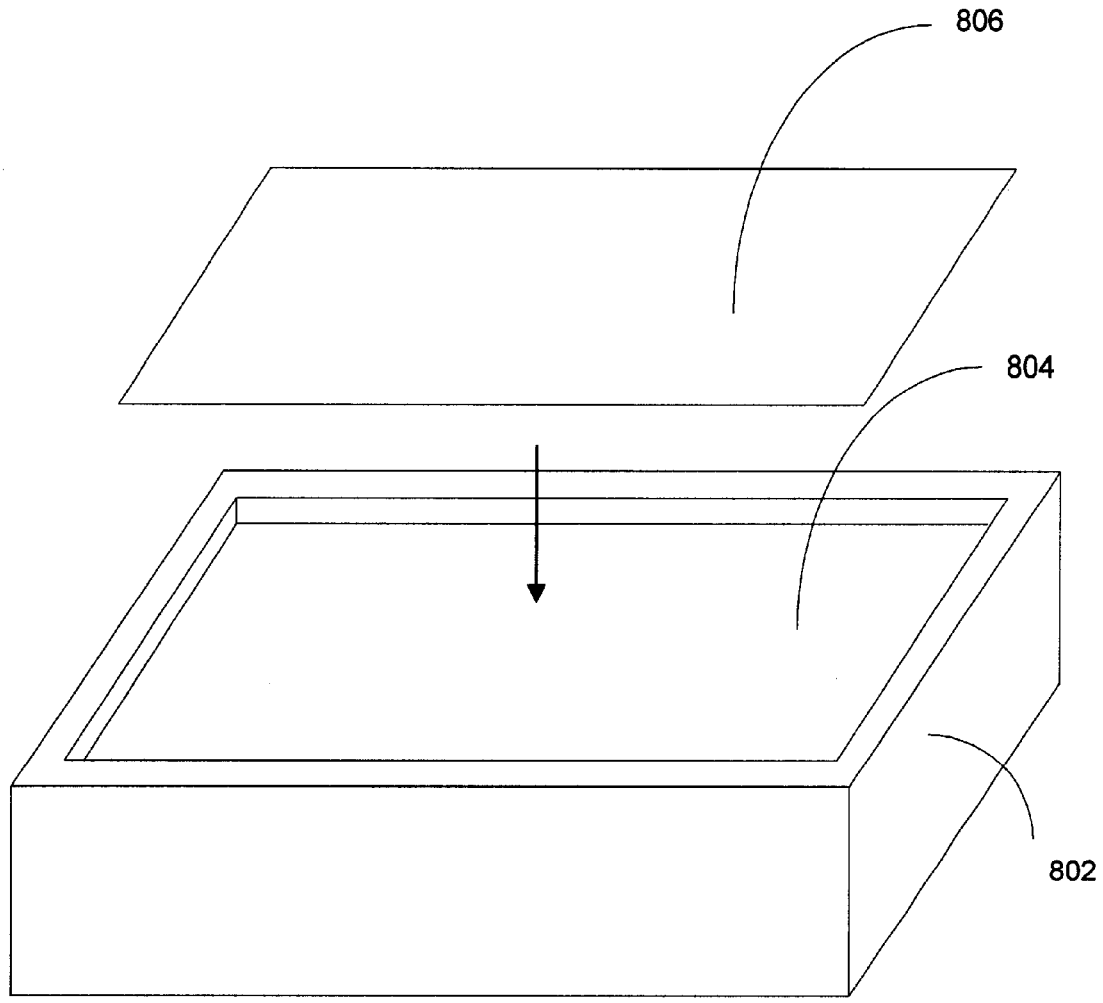
FIG. 8 shows an alternative use of the lenticular arrangement shown in FIG. 4.

FIG. 8 graphically depicts the above-described application. In this figure, a transparency 806 including the lenticules (not shown) is positioned over the surface 804 of a flat display device 802. The transparency 806 may, in one embodiment, include an alternating array of left and right lenticules. The spacing of lenticules is matched to the pixel pitch on the display device 802.

There are other applications of the lenticular technology described herein. For instance, the above-described technology may find exemplary use in enhancing the presentation of various objects illustrated on a two-dimensional medium, such as depictions of organic molecules, architectural drawings, etc. The medium can be included/incorporated in books, financial cards, greeting cards, advertisements, packaging containers, signs, buttons, jewelry, etc. Further, special optical effects can be produced to reduce perception difficulties experienced by individuals having vision and/or vision-related cognitive disorders. This may enhance their ability to read text, e.g., by focusing their attention on favorable depth planes.

Other modifications and variations to the embodiments described above can be made without departing from the spirit and scope of the invention, as is intended to be encompassed by the following claims and their legal equivalents.

What is claimed is:

1. An apparatus for providing an optical effect, comprising:

a processor for controlling the operation of the apparatus; an interface for receiving image information including multiple image elements; and a printing head including a first dispensing mechanism for dispensing a first type of ink, and a second dispensing mechanism for dispensing a second type of ink;

wherein the processor includes printing logic for instructing the printing head to print at least one image element on a base medium using the first dispensing mechanism, and to print at least one lenticule, at a prescribed position over at least a portion of the at least one image element, using the second dispensing mechanism;

wherein the second type of ink is a substantially transparent colorless ink; and wherein the at least one lenticule optically focuses on at least a portion of the at least one image element to achieve the optical effect.

2. The apparatus according to claim 1, wherein the at least one lenticule has a substantially half-spherical shape.

3. The apparatus according to claim 1, wherein the first and second dispensing mechanisms comprise ink jet dispensing mechanisms.

4. The apparatus according to claim 1, wherein the first ink is a colored ink.

5. The apparatus according to claim 1, wherein the first ink comprises a black-colored ink, and wherein the apparatus further includes additional dispensing mechanisms for dispensing other-colored inks.

6. The apparatus according to claim 1, wherein the second ink forms an optically-focusing convex lenticule upon drying.

7. A method for providing an optical effect, comprising the steps:

accessing an image source containing image information including multiple image elements;

printing at least one image element on a base medium using a first type of ink; and printing at least one lenticule, at a prescribed position over at least a portion of the at least one image element, using a second type of ink;

wherein the second type of ink is a substantially transparent colorless ink; and wherein the at least one lenticule optically focuses on at least a portion of the at least one image element to achieve the optical effect.

8. The method according to claim 7, wherein the at least one lenticule has a substantially half-spherical shape.

9. The method according to claim 7, wherein the steps of printing comprise printing with an ink jet printer.

10. The method according to claim 7, wherein the first ink is a colored ink.

11. The method according to claim 7, wherein the first ink comprises a black-colored ink, and wherein the apparatus further includes the additional steps of printing additional image elements using other-colored inks.

12. The method according to claim 7, wherein the second ink forms an optically-focusing convex lenticule upon drying.

13. The method according to claim 7, wherein the at least one lenticule has a substantially half-cylindrical shape.

14. The method according to claim 7, wherein the base medium is a paper-based product.

15. The method according to claim 7, wherein the base medium is a transparency.

16. The method according to claim 15, further including the additional step of positioning the transparency, after the at least one image element and the at least one lenticule have been formed thereon, on a surface of an electronic display.

17. A medium for providing an optical effect, comprising:

a base medium;

at least one image element printed on the base medium using a first type of ink; and at least one lenticule printed at a prescribed position over at least a portion of the at least one image element using a second type of ink;

wherein the second type of ink is a substantially transparent colorless ink; and wherein the at least one lenticule optically focuses on at least a portion of the at least one image element to achieve the optical effect.

18. The medium according to claim 17, wherein the at least one lenticule has a substantially half-spherical shape.

19. The medium according to claim 17, wherein the first ink is a colored ink.

20. The medium according to claim 17, wherein the first ink comprises a black-colored ink, and wherein additional image elements are printed using other-colored inks.

21. The medium according to claim 17, wherein the second ink forms an optically-focusing convex lenticule upon drying.

22. The medium according to claim 17, wherein the base medium is a paper-based product.

23. The medium according to claim 17, wherein the base medium is a transparency.

* * * * *